United States Patent [19]

Christianson

[11] Patent Number: 4,879,995

[45] Date of Patent: Nov. 14, 1989

[54] SNORKEL FOR SKIN DIVERS

[76] Inventor: Tony Christianson, 277 Grulla Ct., Norco, Calif. 91760

[21] Appl. No.: 107,987

[22] Filed: Oct. 13, 1987

[51] Int. Cl.[4] ..... B63C 11/16

[52] U.S. Cl. ..... 128/201.11; 128/201.27

[58] Field of Search ..... 128/201.11, 201.27, 128/200.29

[56] References Cited

U.S. PATENT DOCUMENTS

| | | | |
|---|---|---|---|
| 1,197,115 | 9/1916 | Fell . | |
| 2,317,236 | 4/1943 | Wilen et al. | 128/201.11 |
| 2,753,865 | 7/1956 | Van Der Kogel | 128/201.11 |
| 2,814,292 | 11/1957 | Girden | 128/201.11 |
| 4,071,924 | 1/1978 | Blanc | 128/201.11 |
| 4,278,080 | 7/1981 | Schuch | 128/201.11 |
| 4,655,212 | 4/1987 | Delphia | 128/201.11 |

FOREIGN PATENT DOCUMENTS

| | | | |
|---|---|---|---|
| 102346 | 4/1898 | Fed. Rep. of Germany | 128/201.11 |
| 472977 | 7/1952 | Italy | 128/201.11 |
| 163795 | 8/1985 | Japan | 128/201.11 |

*Primary Examiner*—Max Hindenburg

*Assistant Examiner*—John P. Lacyk

[57] ABSTRACT

The improved snorkel includes a conduit whose length is divided by a bell shaped chamber. A chamber purge valve is located above the water surface when the snorkel is in the approximate position of use by a skin diver swimming face down on the water surface. The chamber purge valve drains the chamber and upper conduit of water when the skin diver returns to the surface after swimming or diving underwater. After a purging exhalation, or after splashing into the open end of the upper conduit due to swimming movements or wave action or the like, the forces of molecular cohesion and adhesion cause water to flow down the inside surface of the upper conduit and chamber to the chamber purge valve. The purge valve opens under slight hydrostatic pressure and drains the water to ambient at a rate sufficient to prevent overflow into the lower conduit. In an alternate configuration, drainage is facilitated by another purge valve located at the bottom of a second chamber below the mouthpiece. The second chamber also serves to capture water which drains through the mouthpiece of which overflows from the upper conduit.

20 Claims, 6 Drawing Sheets

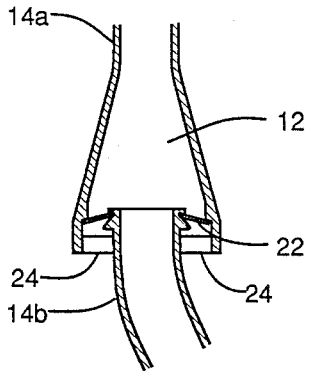
FIG. 4
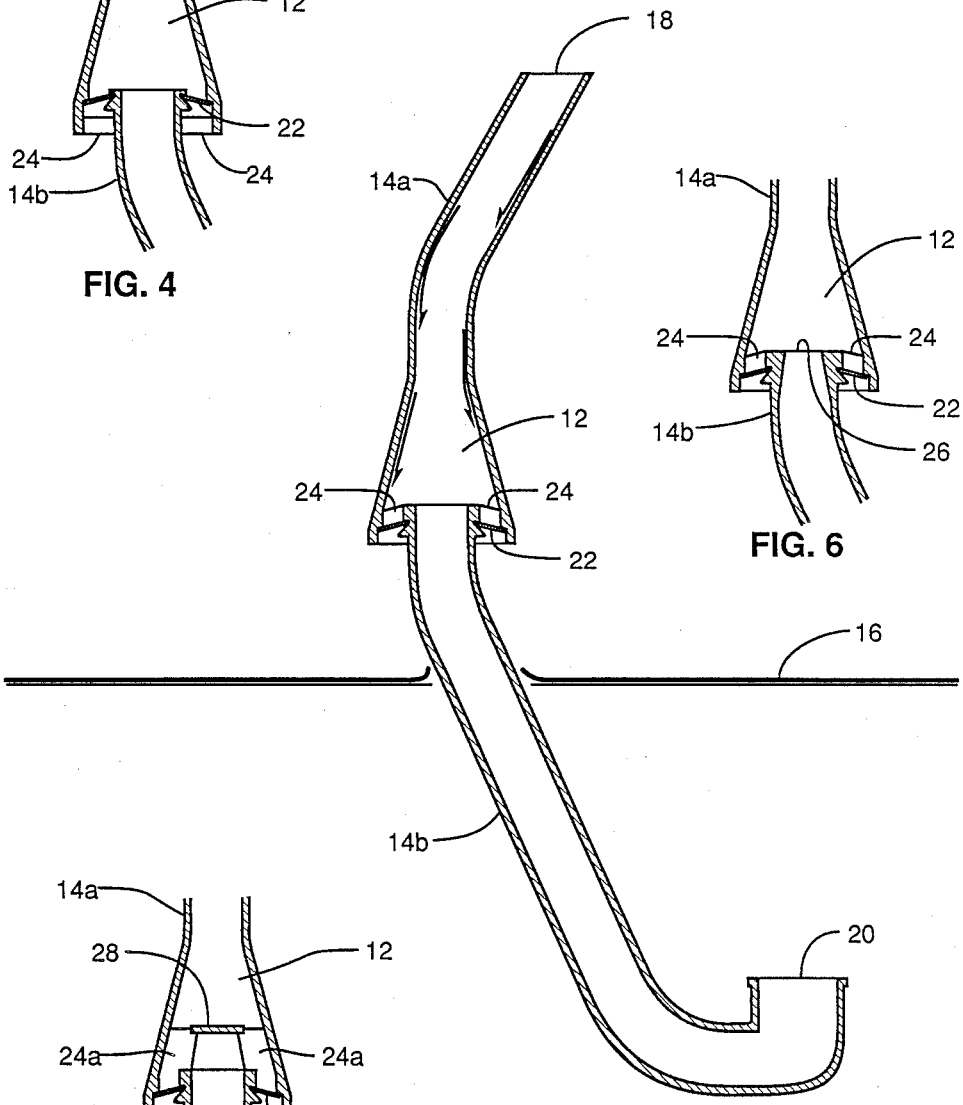
FIG. 5
FIG. 6
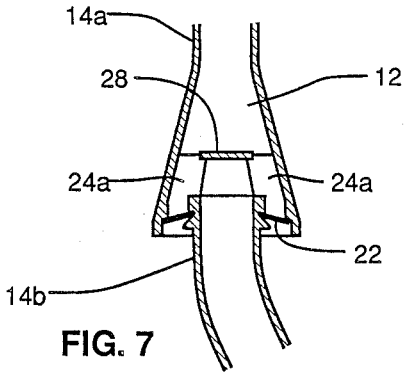
FIG. 7

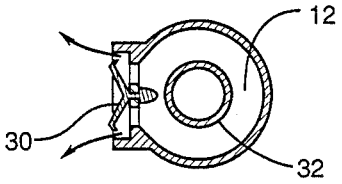
FIG. 9
FIG. 9a
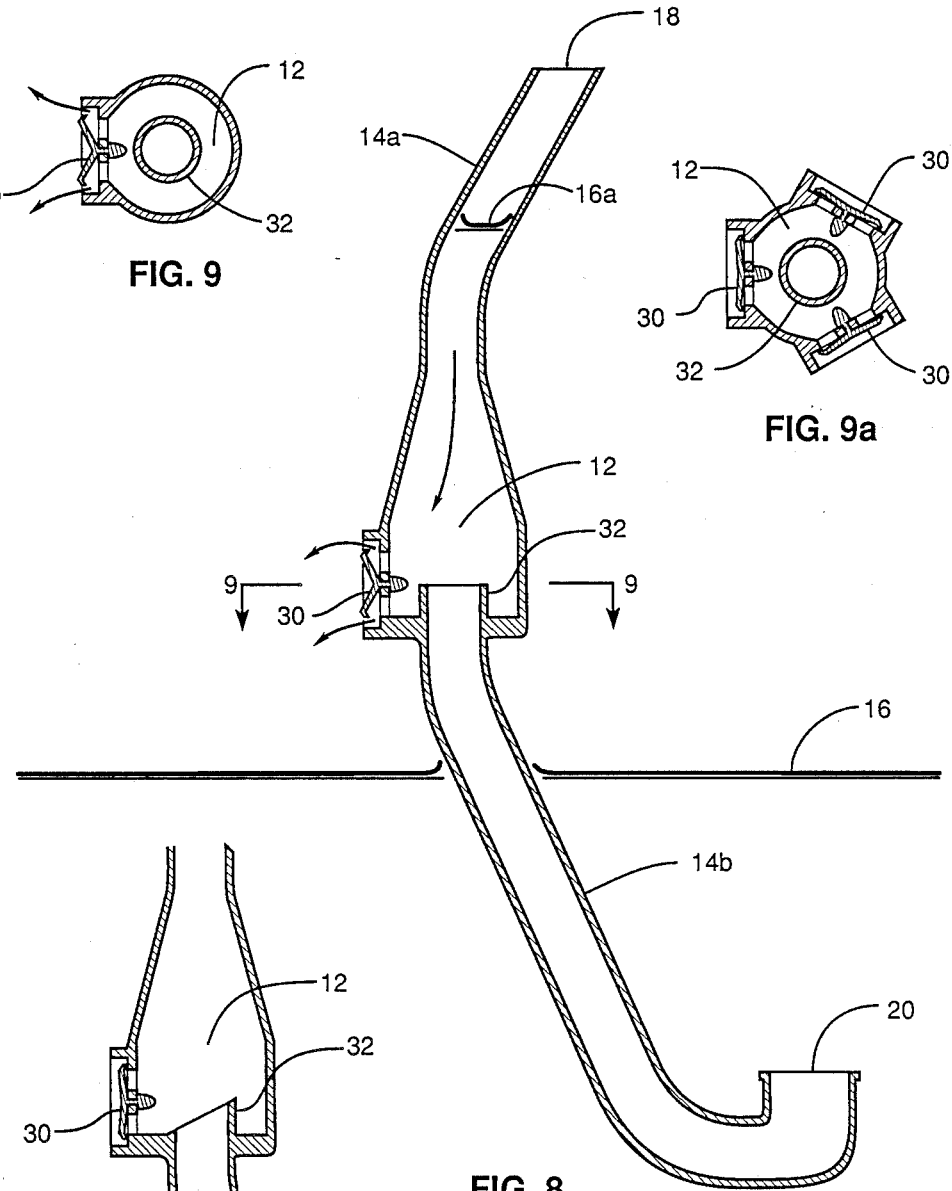
FIG. 8
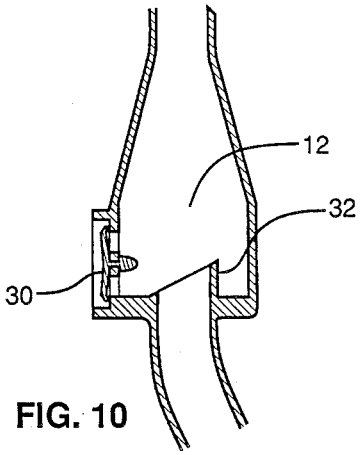
FIG. 10

SNORKEL FOR SKIN DIVERS

BACKGROUND OF THE INVENTION

1. Field of the Invention

The present invention is generally related to snorkels used by skin divers. More particularly, this invention is related to devices for purging water from a snorkel.

2. Description of the Prior Art

Skin divers use the snorkel as a means to breathe while swimming face down on the water surface. The snorkel functions as a conduit between the diver's mouth and the overhead air (hereinafter "skin diver" and "diver" will be used interchangeably). Typically, when in use, the open end of the snorkel conduit extends a short distance above the diver's head. Occasionally, due to swimming movements or wave action, small amounts of water flow into the open end of the snorkel and partially flood the conduit. Also, water will flood the snorkel when the diver swims or dives below the water surface. An experienced skin diver can sense when water enters the snorkel and responds by immediately stopping inhalation. Respiration is resumed after the snorkel has been purged of water.

Inexperienced skin divers find occasional flooding especially troublesome because, undetected, water can be inhaled resulting in coughing and extreme discomfort. Consequently, several designs have been proposed to restrict or block the normally open end of the snorkel and thereby prevent water from entering.

U.S. Pat. No. 4,071,024 entitled Snorkel, issued to Max A. Blanc on Jan. 31, 1978, teaches an air entrapping cap which is mounted on the above water opening of the snorkel. A tortuous passage in the cap retards water flow into the snorkel. Although such a cap is somewhat effective in blocking the occasional flow of surface water into the snorkel, it also retards expulsion of water which enters the snorkel during a dive or swim below the water surface. The significant increase in respiratory and purging effort limits its utility and popularity.

U.S. Pat. No. 2,317,236 entitled Breathing Apparatus for Swimmers, issued to C. H. Wilen, et al, on Apr. 20, 1943, teaches a valve with a buoyant ball arranged to block the above water end of the snorkel whenever water starts to enter. Such valves are bulky, often fail to seal and, also, significantly interfere with respiration. Although once popular, such devices are now considered unreliable and obsolete.

The open snorkel conduit will be completely flooded with water when a skin diver returns to the surface after swimming or diving underwater. The open end of the snorkel is above the water surface when the skin diver assumes the face down, surface swimming attitude. With the open end of the snorkel above the water surface, the conduit is purged for respiration by exhaling an explosive blast of air into the mouthpiece.

Surface tension forms the purging blast of air into a bubble which spans the cross section of the conduit. Pressure within the bubble expands the bubble toward the open end of the snorkel conduit. As the leading surface of the bubble moves away from the mouthpiece, the bulk of the water within the conduit is pushed ahead of the bubble and out the open end.

The purging bubble of air will slip past water which adheres to the inside surface of the conduit. In general, little water will remain on the conduit's inside surface when the driving pressure within the bubble is substantially higher than ambient. Consequently, the purging bubble of air will slip past significant amounts of water only in the upper third of the conduit because the purging pressure of the explosively exhaled air is rapidly dissipated by distance from the mouthpiece.

After the purging air bubble is spent, residual water will flow down the inside surface toward the mouthpiece. Also, water which splashes into the open end of the snorkel conduit due to swimming movements or wave action will typically strike and adhere to the inside surface of the upper third of the conduit and thereafter flow down the surface toward the mouthpiece. Water accumulates at the lowermost portion of the snorkel conduit, typically under the mouthpiece, and obstructs the conduit. If the conduit is not completely blocked, a slow and cautious inhalation is possible after which another purging exhalation can be made.

The respiratory effort needed to purge a snorkel is significant. Many skin divers lack the respiratory strength needed to completely purge the snorkel with a single exhalation, and must repeat the purging procedure several times. Also, water will sometimes enter the snorkel just as the diver has completed an exhalation, leaving very little air in the lungs to satisfactorily complete a purge. Consequently, a means which decreases the respiratory effort and the amount of air required to purge a snorkel will be very beneficial.

A popular solution places an externally directed purge valve in the snorkel conduit at a location near the snorkel mouthpiece. Water in a flooded conduit which extends above the ambient water surface will drain through a purge valve. In other words, a purge valve drains the snorkel conduit until the water level within the conduit matches the ambient water level. Theoretically, because the total volume of water in the flooded snorkel is reduced by the initial flow through the purge valve, the respiratory effort required to purge the remaining water is also reduced.

Unfortunately, a purge valve also provides an alternate path for forcefully exhaled air. A purge valve will quickly and wastefully dissipate the explosive blast of purging air when the purge valve is located close to the mouthpiece. One solution to this problem places a purge valve in the snorkel conduit at a location approximately midway between the mouthpiece and the open end of the snorkel conduit.

At mid-length of the snorkel conduit, the purge valve will be close to the ambient water surface when the skin diver is swimming face down on the water surface. At such a location, the purge valve will drain that portion of the snorkel conduit which extends above the purge valve and the water surface, but will not initially interfere with the purging blast of air. Even at this location, the purge valve will dissipate the forcefully exhaled air and the amount of residual water adhering to the inside surface of the conduit between the purge valve and the open end will be substantial. Residual water subsequently accumulates at the lowermost portion of the snorkel conduit and obstructs the conduit. Consequently, a purge valve by itself, even when located mid-length of the snorkel conduit, is of limited benefit.

U.S. Pat. No. 4,278,080 entitled Diving Snorkel, issued to Joseph N. Schuch on July 14, 1981, teaches a purge valve located at the bottom of a branch conduit which joins the snorkel conduit at a location approximately midway between the mouthpiece and the open end. The purge valve drains the snorkel conduit until the water level within the conduit matches the ambient water level. Part of the purging air will divert into the branch conduit and force water within the branch conduit out the purge valve. Schuch teaches that the branch conduit must have sufficient length to provide the transient resistance necessary to allow purging of the snorkel conduit before the purging air reaches and is dissipated by the purge valve.

Water within the snorkel conduit of Schuch is pushed out the open end before the purging air clears the branch conduit of water and reaches the purge valve. Nevertheless, diverting part of the purging bubble of air into a branch conduit abates the driving pressure within the purging bubble and allows significant residual water to adhere to the upper portion of the snorkel conduit. Consequently, although the snorkel configuration of Schuch somewhat reduces the effort required to purge a flooded snorkel, it does not decrease the amount of purging air required, and it does not reduce residual water which adheres to the snorkel's inside surface and soon flows down the conduit to obstruct the snorkel near the mouthpiece. Also, the branch conduit adds significantly to the size of the snorkel, making the snorkel unwieldy in use.

SUMMARY OF THE INVENTION

In view of the foregoing factors and conditions which are characteristic of the prior art, it is one objective of the present invention to provide an improved purge valve for skin diving snorkels which enables a skin diver to purge water from a flooded snorkel with a minimum of respiratory effort and a minimum of air.

Another objective of the present invention is to capture and eliminate residual water which adheres to and flows down the inside surface of the snorkel conduit after a purging procedure.

Another objective of the present invention is to capture and eliminate water which splashes into the open end of the snorkel conduit due to swimming movements or wave action or the like.

Another objective of the present invention is to provide a purging means which is compact and does not contribute significantly to the size of the snorkel.

In accordance with an embodiment of the present invention, an improved skin diving snorkel is described. The improved snorkel includes a conduit whose length is divided by a chamber located above the water surface when the snorkel is in the approximate position of use by a skin diver swimming face down on the water surface. A flared transition from the inside cross section of the upper conduit to the larger inside cross section of the chamber is smooth and without break. A chamber purge valve initially drains the chamber and upper conduit of water when the skin diver returns to the surface after swimming or diving underwater. The lower conduit is purged for respiration by exhaling a forceful blast of air into the mouthpiece which pushes the water upward. The effort required to purge the improved snorkel is reduced because the bulk of the ascending water flows out the chamber purge valve, without the need to overflow the snorkel top. After a purging procedure, or after splashing into the open end of the upper conduit due to swimming movements or wave action or the like, the forces of molecular cohesion and adhesion cause water to flow down the inside surface of the upper conduit and chamber to the chamber purge valve. The purge valve opens under slight hydrostatic pressure and drains the water to ambient at a rate sufficient to prevent overflow into the lower conduit. In an alternate configuration, initial drainage is facilitated by a second purge valve located at the bottom of a second chamber below the mouthpiece. The second chamber also serves to capture water which drains through the mouthpiece or which overflows from the upper conduit.

DESCRIPTION OF THE DRAWINGS

A detailed description of the invention is made with reference to the accompanying drawings wherein like numerals designate corresponding parts in the several Figures.

FIG. 4 is a partial sectional view of the snorkel of FIG. 2 showing an alternate structural arrangement.

FIG. 5 is a view similar to FIG. 2, showing the snorkel after a purging exhalation.

FIGS. 6 and 7 are each partial sectional views of the snorkel of FIG. 2 showing alternate internal configurations.

FIG. 8 is a longitudinal sectional view of an alternate snorkel configuration which has been constructed in accordance with the principles of the present invention, shown flooded with that portion above the purge valve draining to ambient.

FIGS. 9 and **9*a* are each sectional views of alternative constructions the snorkel of FIG. 8, taken along a plane corresponding to line 9—9 of FIG. 8**.

FIG. 10 is a partial sectional view of the snorkel of FIG. 8 showing another alternate internal configuration.

DESCRIPTION OF THE PREFERRED EMBODIMENT

The following detailed description is of the best presently contemplated modes of carrying out the invention. This description is not to be taken in a limiting sense, but is made merely for purposes of illustrating the general principles of the invention.

Figure 1:
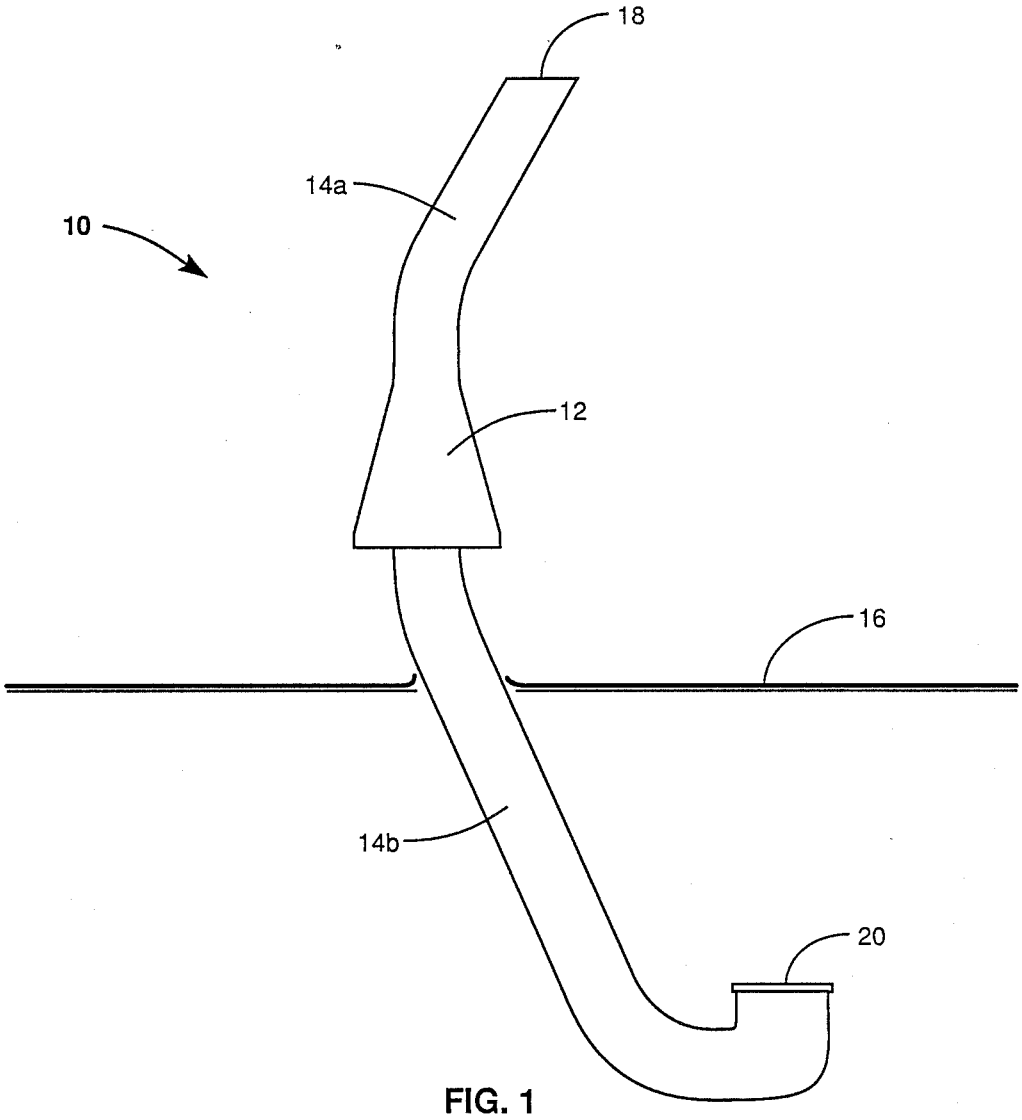
FIG. 1 is a front elevation view of a snorkel which has been constructed in accordance with the principles of the present invention, and which is pictured in the approximate position of use by a skin diver swimming face down on the water surface.
Figure 2:
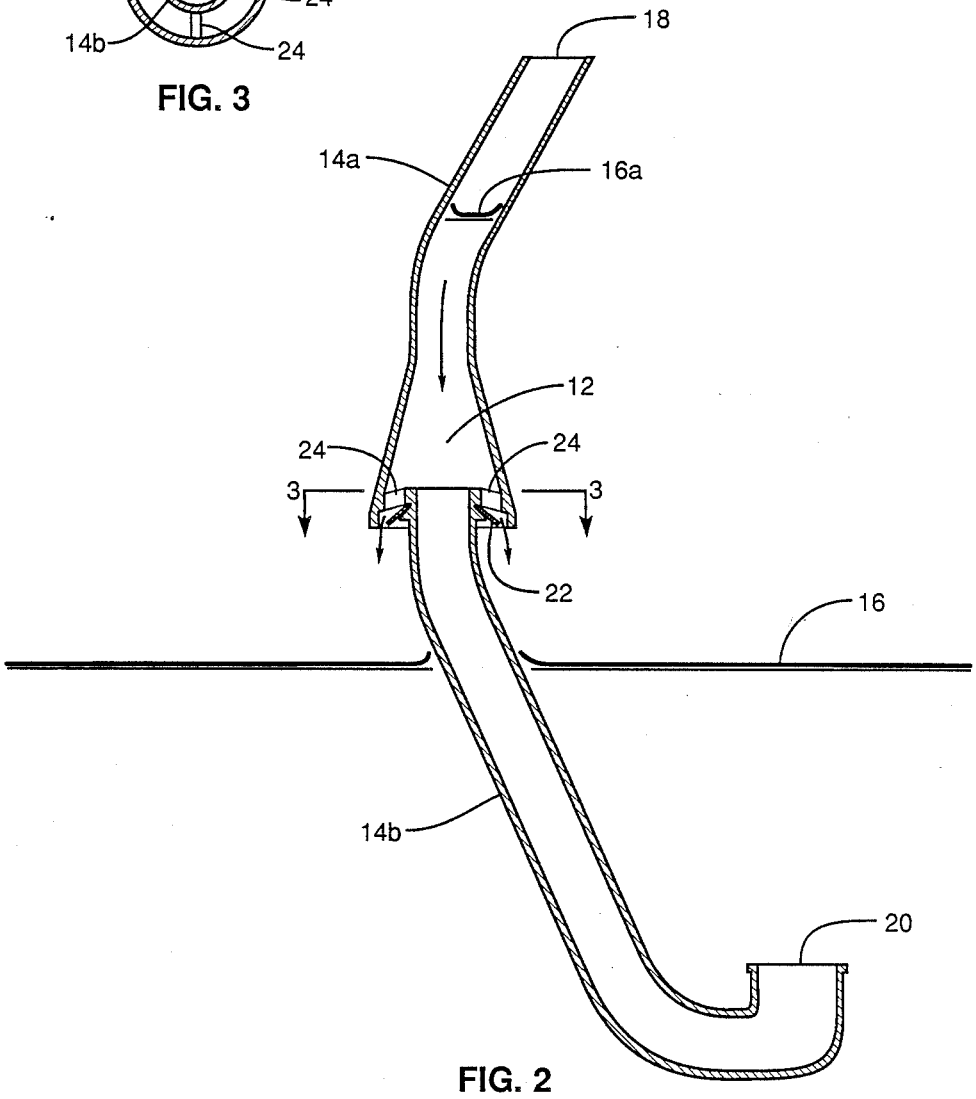
FIG. 2 is a longitudinal sectional view of the snorkel of FIG. 1, shown flooded with that portion above the purge valve draining to ambient.

Referring to FIGS. 1 and 2, improved snorkel 10 is pictured in the approximate position of use by a skin diver swimming face down on the water surface. Snorkel 10 includes a conduit whose length is divided by chamber 12 into upper conduit **14*a* and lower conduit 14*b*. Chamber 12 is located so as to be above ambient water surface 16 when snorkel 10** is in use.

Upper conduit **14*a* extends into the air above water surface 16 and has an end with opening 18. Air or water can freely enter conduit 14*a* because opening 18 is not obstructed or restricted and provides fluid flow there-through with little or no resistance. Upper conduit 14a curves smoothly to place opening 18 approximately over the center of the skin diver's head. Alternately, upper conduit 14a** can be straight.

Lower conduit 14b curves smoothly under water surface 16 to join with upward opening mouthpiece 20. Mouthpiece 20 is adapted to be held by the mouth of the diver and opens a flow path from opening 18 to the interior of the mouth.

Conduits 14a and 14b are configured to approximately match the curvature of the skin diver's head. Respiration and purging are facilitated by providing a substantially smooth flow path which is free of obstructions and abrupt changes in path direction. While not so limited, the curvature may follow, for example, a generally elliptical path.

Although not so limited, conduits 14a and 14b have the same cross section. The flared transition from the inside cross section of upper conduit 14a to the larger inside cross section of chamber 12 is gradual, smooth and without break. Thus, the surface contour is uniform and without abrupt changes in flow direction.

Purge valve 22 is located adjacent the opening to lower conduit 14b in the bottom of chamber 12. The preferred configuration of purge valve 22 encircles the opening to lower conduit 14b and, accordingly, is annular shaped. Purge valve 22 is oriented to allow water to flow from chamber 12 to ambient.

Figure 3:
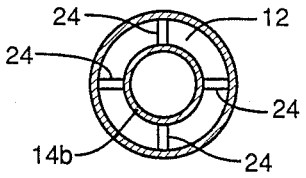
FIG. 3 is a sectional view of the snorkel, taken along a plane corresponding to line 3—3 of FIG. 2.

Referring to FIG. 3, structural members 24 bridge the annular opening which includes purge valve 22, thereby joining the sides of chamber 12 to conduit 14b. Structural members 24 are relatively thin plates spaced to provide unrestricted flow into purge valve 22. Referring to FIG. 4, there is shown an alternate location for structural members 24.

Purge valve 22 is, typically, a flexible diaphragm of a thin, soft and resilient material, for example silicone elastomer or the like, which is restrained in such a way that the unrestrained edge can selectively flex under low pressure to allow flow in one direction only. Reverse pressure forces the diaphragm to seal closed the opening it covers. Consequently, purge valve 22 will prevent the reverse flow of ambient water into chamber 12.

When a skin diver swims or dives below the water surface, water will pour into snorkel 10 through opening 18, completely flooding the snorkel. After the skin diver resurfaces and assumes the face down, surface swimming attitude, water (depicted as having surface 16a in FIG. 2) above ambient water surface 16 will drain (depicted as arrows in FIG. 2) through purge valve 22. Referring to FIG. 2, the outflow of water has flexed purge valve 22 outward.

Water in lower conduit 14b is purged by exhaling a forceful blast of air into mouthpiece 20. Surface tension forms the purging blast of exhaled air into a bubble which spans the cross section of conduit 14b. Pressure expands the bubble away from mouthpiece 20. As the leading surface of the bubble moves away from mouthpiece 20, the bulk of water within lower conduit 14b is pushed ahead of the bubble and lifted into chamber 12. When water surface 16a lifts above ambient water surface 16 into chamber 12, the water will flow out of snorkel 10 through purge valve 22.

Purge valve 22 will dissipate a portion of the purging air with the benefit of clearing water from chamber 12. Momentum of the ascending water and the pressure of purging air which continues to rise in upper conduit 14a will also carry water out opening 18.

The purging bubble of air will slip past water which adheres to the inside surfaces of conduits 14a and 14b, and chamber 12. In general, very little water will remain on the inside surface of lower conduit 14b because the initial driving pressure within the bubble close to mouthpiece 20 is substantially higher than ambient.

Referring to FIG. 5, after the purging air bubble is spent, the forces of molecular cohesion and adhesion cause residual water to flow (depicted as arrows in FIG. 5) down the inside surface of conduit 14a, and the gradually flared inside surface of chamber 12, to the unrestrained outside edge of purge valve 22. Similarly, water which splashes into opening 18 due to swimming movements or wave action will strike and adhere to the inside surface of upper conduit 14a and thereafter flow to purge valve 22.

The flared transition from the inside cross section of upper conduit 14a to the larger inside cross section of chamber 12 is gradual and uninterrupted such that the forces of molecular cohesion and adhesion maintain a sheet like flow of water which will not break away from the inside surface. Also, the flare angle of chamber 12 is chosen to preclude water from leaving the inside surface of chamber 12 and falling past purge valve 22 into lower conduit 14b. In general, the cohesive and adhesive forces holding the water on the surface must counter the force of gravity pulling the water away from the surface. Although other angles can be utilized, a flare having an included angle of less than thirty degrees (30°) has been determined to be adequate in most cases.

Similarly, the forces of molecular cohesion and adhesion cause water to follow the inside surface of the curve of upper conduit 14a. The radius of curvature is chosen to preclude water parting from the inside surface and falling past purge valve 22 into lower conduit 14b. In general, the cohesive and adhesive forces holding the water on the inside surface must counter the centrifugal and gravitational forces acting on the flowing water as it rounds the curve into chamber 12. Accordingly, a radius of curvature not less than ten centimeters (10 cm) has been determined to be adequate in most cases.

Water flows down the inside wall of chamber 12 directly to the unrestrained outside edge of purge valve 22. Purge valve 22 opens under slight hydrostatic pressure and drains water to ambient at a rate sufficient to prevent overflow into lower conduit 14b. Rapid drainage of water is facilitated by providing purge valve 22 with a flow area at least equal to the internal cross section area of conduit 14a.

Upper conduit 14a and chamber 12 are drained by purge valve 22 when water develops hydrostatic head by being above ambient water surface 16. Purge valve 22 is advantageously located above mid-distance between mouthpiece 20 and opening 18. Above mid-distance between mouthpiece 20 and opening 18, purge valve 22 will normally be above ambient water surface 16 when the skin diver is swimming face down on the water surface and, consequently, purge valve 22 will continuously drain water which flows into chamber 12.

Referring to FIG. 6, there is shown an alternate configuration in which the top of conduit 14b tapers to a reduced cross section area which forms nozzle opening 26 adjacent purge valve 22. Nozzle opening 26 facilitates the ejection of water from conduit 14b during a purging procedure. Of course, nozzle opening 26 is preferably sized to avoid significant air flow resistance during respiration.

Referring to FIG. 7, there is shown yet another alternate configuration in which deflector 28 has been placed in chamber 12 directly in line with the center of conduit 14*a*. Deflector 28 may be planar, curved or conical, as desired. Deflector 28 is supported by extended structural members 24*a*. Deflector 28 assures that water dropping down the center of conduit 14*a* is deflected sideways to strike and subsequently adhere to the inside surface of chamber 12. Deflector 28 is preferably sized to avoid significant interference to air flow during respiration.

Referring to FIGS. 8 and 9, there is shown an alternate configuration which replaces annular purge valve 22 with at least one side mounted purge valve 30 adjacent the opening to lower conduit 14*b*. As shown in FIGS. 8 and 9, water outflow has flexed purge valve 30 outward. Multiple purge valves 30 (see FIG. 9*a*) have the benefit of more rapidly draining water from chamber 12.

The configuration of FIG. 8 incorporates dam 32 to facilitate guidance of water to purge valve 30. Dam 32 is formed by a short extension of lower conduit 14*b* into chamber 12. Alternately, as shown in FIG. 10, the top of dam 32 can slant downward toward the lower edge of purge valve 30.

Figure 11:
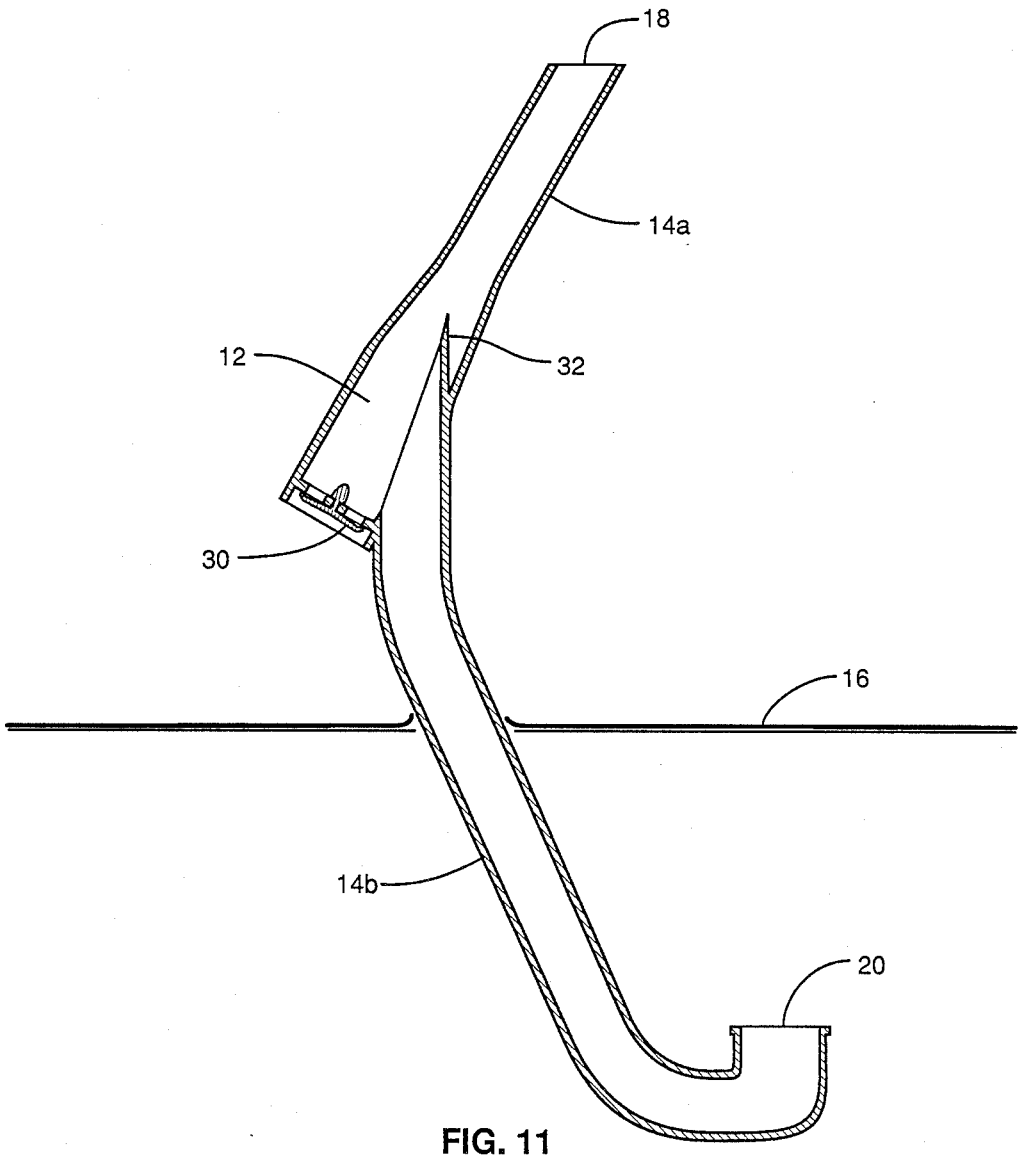
FIG. 11 is a longitudinal sectional view of another alternate snorkel configuration which has been constructed in accordance with the principles of the present invention, shown after a purging exhalation.

Referring to FIG. 11, there is shown an alternate configuration in which the central, longitudinal axis of chamber 12 is set at an angle relative to lower conduit 14*b*.

Figure 12:
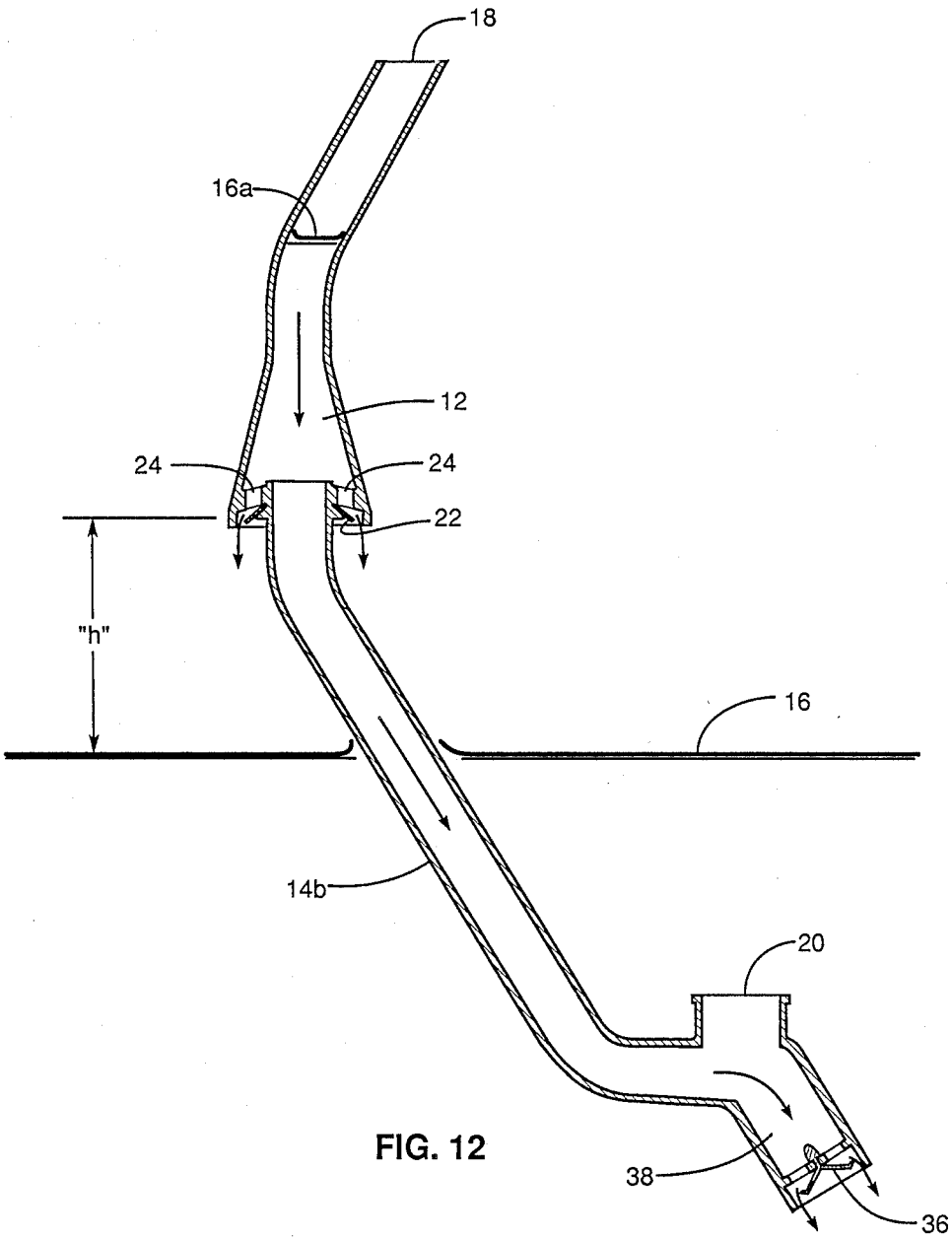
FIG. 12 is a longitudinal sectional view of still another alternate snorkel configuration which has been constructed in accordance with the principles of the present invention, shown flooded with that portion above the ambient water surface draining to ambient.

Referring to FIG. 12, there is shown an alternate configuration of the present invention in which drainage flow (depicted as arrows in FIG. 12) is facilitated by purge valve 36 located at the bottom of lower chamber 38. Lower chamber 38 is formed by extending lower conduit 14*b* below mouthpiece 20. Lower chamber 38 serves to capture water which drains through mouthpiece 20 or which manages to splash past purge valve 22.

Dimension "h" is the vertical distance above water surface 16 of purge valve 22 when snorkel 10 is in use. A purging bubble of air must have internal pressure sufficient to lift water surface 16*a* at least distance "h" to purge valve 22. Advantageously, purge valve 36 is located below water surface 16 at a depth greater than dimension "h". By locating purge valve 36 below water surface 16 at a depth greater than dimension "h", ambient hydrostatic pressure closing purge valve 36 will be greater than the internal pressure of a purging air bubble. Consequently, the loss of purging pressure and air through purge valve 36 will be insignificant.

Water captured by lower chamber 38 is eliminated through purge valve 36 when the snorkel is next purged. Lower chamber 38 is advantageously sized to hold residual water which remains after a purging procedure and also small amounts of water which occasionally splash past chamber 12 or which drains from the mouth through mouthpiece 20. Empirical studies have determined that a chamber volume equivalent to ten percent (10%) of the snorkel's total internal volume is sufficient for this purpose.

Other variations on the diameters of the conduits and chamber are contemplated as are different orientations and deviations from circular cross sections to, for example, elliptical. Snorkels with a single above water chamber are shown and described, but snorkels utilizing several above water chambers are conceivable.

It is understood that those skilled in the art may conceive of modifications and/or changes to the invention described above. Any such modifications or changes which fall within the purview of the description are intended to be included therein as well. This description is intended to be illustrative and is not intended to be limitative. The scope of the invention is limited only by the scope of the claims appended hereto.

I claim:

1. A snorkel device comprising:

a first conduit adapted to extend above the water surface when said snorkel device is in use and supported by a diver swimming face down on the water surface, said first conduit having first and second ends thereof;

said first end of said first conduit being open whereby it is unobstructed and freely admits ambient fluid into said snorkel device;

a length of said first conduit adjacent said second end of said first conduit expands thereby forming a first chamber which has flared sides, said first chamber having bottom and ambient openings thereof;

said length of said first conduit expands such that the forces of cohesion and adhesion cause water to flow down the inner surface of said first conduit and said first chamber to said ambient opening;

a second conduit adapted to extend below the water surface, and having first and second ends thereof;

said first end of said second conduit joined to communicate fluid flow with said first chamber via said first chamber bottom opening;

mouthpiece means adjacent said second end of said second conduit and joined to communicate fluid flow with the interior of said second conduit; and purge valve means disposed in said first chamber ambient opening and arranged to provide unidirectional fluid flow to ambient from the interior of said first chamber.

2. The snorkel device recited in claim 1 wherein:

said length of said first conduit forms a cone having a vertex angle not greater than thirty degrees (30°).

3. The snorkel device recited in claim 2 wherein:

the interior surfaces of said first conduit and said cone blend smoothly together without interruption.

4. The snorkel device recited in claim 1 wherein:

said first chamber ambient opening encircles said first chamber bottom opening.

5. The snorkel device recited in claim 1 wherein:

said first chamber is located above midway between said first conduit first end and said second conduit second end.

6. The snorkel device recited in claim 1 wherein:

said purge valve means includes flexible diaphragm means mounted at said first chamber ambient opening to selectively open and close said ambient opening thereby to permit unidirectional flow to ambient from said first chamber.

7. The snorkel device recited in claim 1 wherein:

said ambient opening has a flow area at least equal to the inside cross section of said first conduit.

8. The snorkel device recited in claim 1 wherein:

said first conduit defines a smoothly curving path between said first conduit first end and said first chamber.

9. The snorkel device recited in claim 8 wherein:

said smoothly curving path has a radius of curvature not less than ten centimeters (10 cm).

10. The snorkel device recited in claim 1 wherein:

said second conduit defines a smoothly curving path between said second conduit second end and said first chamber.

11. The snorkel device recited in claim 1 wherein:

said mouthpiece and said second conduit second end are integrally formed.

12. The snorkel device recited in claim 1 including:

an annular dam at least partially encircling said first chamber bottom opening.

13. The snorkel device recited in claim 1 wherein:

said second conduit first end forms a tapered nozzle opening to said first chamber.

14. The snorkel device recited in claim 1 including:

deflector means interposed between said first chamber top and bottom openings.

15. The snorkel device recited in claim 1 including:

a second chamber adjacent said mouthpiece means, said second chamber having first and ambient openings thereof;

said second chamber first opening joined to communicate fluid flow with said second end of said second conduit; and said second chamber ambient opening having purge valve means arranged to selectively provide unidirectional flow from the interior of said second chamber to ambient.

16. The snorkel device recited in claim 15 wherein:

said second chamber has an internal volume at least equivalent to ten percent (10%) of the total internal volume of said snorkel device.

17. A snorkel device comprising:

a conduit having an open top which is unobstructed and which freely admits ambient fluid, and a bottom end;

mouthpiece means adjacent to said bottom end of said conduit and joined to communicate fluid flow with the interior of said conduit;

a portion of said conduit between said open top and said bottom end having a flared length which forms a chamber which is larger at the bottom than at the top such that the forces of cohesion and adhesion cause water to establish substantially sheet flow which follows the inner surface of said conduit and said chamber to said chamber bottom;

said chamber having at least one opening to ambient adjacent said chamber bottom;

at least said opening to ambient in said chamber located above the water surface when said snorkel device is in use and supported by a diver swimming face down on the water surface; and purge valve means disposed in said chamber opening to ambient and oriented to selectively provide unidirectional flow to ambient from said chamber.

18. The snorkel device recited in claim 17 including:

a second chamber adjacent said mouthpiece means, having top and ambient openings thereof;

said second chamber top opening joined to communicate fluid flow with said conduit bottom end; and a second purge valve means disposed in said second chamber ambient opening arranged to selectively provide unidirectional flow to ambient from said second chamber.

19. A snorkel comprising:

a first conduit adapted to extend above the water surface when said snorkel is in use and supported by a diver swimming face down on the water surface, said first conduit having first and second ends thereof;

said first conduit first end being open whereby it is unobstructed and freely admits ambient fluid into said snorkel;

a length of said first conduit adjacient said first conduit second end gradually opens outward thereby forming a first chamber which is larger at the bottom than at the top;

said first chamber having bottom and ambient openings thereof;

said first conduit and said first chamber provide a smooth inner surface with uniform contour such that the forces of cohesion and adhesion cause water to follow said inner surface of said first conduit and said first chamber to said ambient opening of said first chamber;

said first conduit and said first chamber providing an unobstructed fluid flow path between said first conduit first end and said first chamber bottom opening;

a second conduit adapted to extend below the water surface, and having first and second ends thereof;

said second conduit first end joined to communicate fluid flow with said first chamber via said first chamber bottom opening;

mouthpiece means adjacent said second conduit second end and joined to communicate fluid flow with the interior of said second conduit; and purge valve means disposed in said first chamber ambient opening arranged to provide unidirectional fluid flow to ambient from the interior of said first chamber.

20. A diving snorkel comprising:

first conduit means of substantially constant cross section, said first conduit means having first and second ends thereof, mouthpiece means joined to communicate fluid flow with said first end of said first conduit means, second conduit means of substantially constant cross section, said second conduit means having first and second ends thereof, chamber means having a substantially conical shape, said chamber means having first and second ends thereof, said chamber means first end being larger than said chamber means second end, said first end of said second conduit means joined to communicate surface adhesion liquid flow and unobstructed respiratory flow with said second end of said chamber means, said second end of said first conduit means joined to communicate unobstructed respiratory flow with said first end of said chamber means, and purge valve means formed between said second end of said first conduit means and said first end of said chamber means, said purge valve means surrounds said second end of said first conduit means.

* * * * *